US007661156B2

(12) United States Patent
Thorne et al.

(10) Patent No.: US 7,661,156 B2
(45) Date of Patent: Feb. 16, 2010

(54) PORTABLE FOLDING PLAY YARD WITH STABILIZED CORNER POSTS

(75) Inventors: Henry F. Thorne, West View, PA (US); Robert D Daley, Pittsburgh, PA (US)

(73) Assignee: Thorley Industries, LLC, Pittsburgh, PA (US)

( * ) Notice: Subject to any disclaimer, the term of this patent is extended or adjusted under 35 U.S.C. 154(b) by 0 days.

(21) Appl. No.: 11/675,098

(22) Filed: Feb. 15, 2007

(65) Prior Publication Data

US 2008/0196163 A1 Aug. 21, 2008

(51) Int. Cl.
*A47C 7/00* (2006.01)

(52) U.S. Cl. ..... 5/99.1; 5/93.1

(58) Field of Classification Search ..... 5/99.1, 5/98.1, 93.1

See application file for complete search history.

(56) References Cited

U.S. PATENT DOCUMENTS

| | | | |
|---|---|---|---|
| 2,670,477 | A | 3/1954 | Pond |
| 2,825,071 | A | 3/1958 | Landry et al. |
| 3,119,124 | A | 1/1964 | Krauss |
| 3,206,773 | A | 9/1965 | Sarasin |
| 3,309,718 | A | 3/1967 | Sarasin |
| 3,430,273 | A | 3/1969 | Stillwaugh |
| 3,848,278 | A | 11/1974 | Propst |
| 4,811,437 | A | 3/1989 | Dillner et al. |
| 4,819,285 | A | 4/1989 | Fetters |
| 4,837,875 | A | 6/1989 | Shamie et al. |
| 4,985,948 | A | 1/1991 | Mariol |
| 5,025,517 | A | 6/1991 | Johnson |
| 5,197,154 | A | 3/1993 | Shamie |
| 5,239,714 | A | 8/1993 | Huang |
| 5,241,716 | A | 9/1993 | Kohus |
| 5,243,718 | A | 9/1993 | Shamie |
| 5,279,006 | A | 1/1994 | Teng |
| 5,293,656 | A | 3/1994 | Chan |
| 5,353,451 | A | 10/1994 | Hsiung |
| 5,358,220 | A | 10/1994 | Yu-Kuang |
| 5,363,521 | A | 11/1994 | Garland et al. |
| 5,367,725 | A | 11/1994 | Tsai |
| 5,381,570 | A | 1/1995 | Cheng |
| D359,869 | S | 7/1995 | Oren |
| 5,504,951 | A | 4/1996 | Yeh |
| 5,513,399 | A | 5/1996 | Weng |
| 5,530,977 | A | 7/1996 | Wang |
| 5,615,427 | A | 4/1997 | Huang |

(Continued)

OTHER PUBLICATIONS

PCT/US2008/53856—International Search Report. dated Nov. 4, 2008.

(Continued)

*Primary Examiner*—Fredrick Conley
(74) *Attorney, Agent, or Firm*—The Webb Law Firm

(57) ABSTRACT

A folding play yard includes a collapsible play yard frame movable between a retracted stored position and a deployed position, wherein the frame defines a baby receiving portion in the deployed position with a floor and bordering side walls around the periphery of the floor, wherein the frame includes a plurality of corner posts forming at least a portion of a support for the side walls with the play yard in the deployed position, wherein the corner posts are constructed to remain substantially parallel to a vertical axis of the play yard as the play yard moves between the closed and the open position.

14 Claims, 9 Drawing Sheets

U.S. PATENT DOCUMENTS

| | | | | |
|---|---|---|---|---|
| 5,809,592 | A | 9/1998 | McAllister | |
| 5,867,851 | A | 2/1999 | Mariol et al. | |
| 5,911,653 | A | 6/1999 | Cheng | |
| 6,125,483 | A | 10/2000 | Stroud et al. | |
| 6,256,814 | B1 * | 7/2001 | Drobinski | 5/99.1 |
| 6,317,907 | B1 | 11/2001 | Wang | |
| 6,336,234 | B1 | 1/2002 | Kuo | |
| 6,343,390 | B1 | 2/2002 | Yang et al. | |
| 6,357,462 | B1 | 3/2002 | Laosunthara et al. | |
| 6,421,850 | B1 | 7/2002 | Welsh, Jr. | |
| 6,473,919 | B1 | 11/2002 | Wang | |
| 6,510,568 | B1 | 1/2003 | Drobinski et al. | |
| 6,634,038 | B2 | 10/2003 | Hsia | |
| 6,684,420 | B2 | 2/2004 | Koenig et al. | |
| 6,851,135 | B1 | 2/2005 | Chen | |
| 7,043,779 | B2 | 5/2006 | Mendenhall et al. | |
| 7,069,605 | B2 | 7/2006 | Harvey, III | |
| 7,343,634 | B2 | 3/2008 | Song | |
| 2003/0061657 | A1 | 4/2003 | Longenecker et al. | |
| 2006/0021137 | A1 | 2/2006 | Waldman et al. | |
| 2006/0021138 | A1 | 2/2006 | Waldman et al. | |
| 2006/0037137 | A1 | 2/2006 | Song | |
| 2006/0174406 | A1 | 8/2006 | Yang | |
| 2006/0185082 | A1 | 8/2006 | Casati Troutman | |
| 2006/0225204 | A1 | 10/2006 | Bretschger et al. | |
| 2006/0225208 | A1 | 10/2006 | Chen | |
| 2007/0017025 | A1 | 1/2007 | Myer | |
| 2007/0157379 | A1 | 7/2007 | Lin | |
| 2007/0163041 | A1 | 7/2007 | Cheng | |
| 2007/0277308 | A1 | 12/2007 | Chen et al. | |

OTHER PUBLICATIONS

PCT/US2008/53856—Written Opinion of the International Searching Authority. dated Nov. 4, 2008.

PCT/US2008/53856—Notification of Transmittal of the International Search Report and the Written Opinion of the International Searching Authority or the Declaration. Nov. 4, 2008.

* cited by examiner

PORTABLE FOLDING PLAY YARD WITH STABILIZED CORNER POSTS

BACKGROUND OF THE INVENTION

1. Field of the Invention

The present invention relates to play yards, and more particularly the present invention is directed to a folding play yard with stabilized corner posts.

2. Background Information

A play yard, also known as a playpen, is a piece of furniture in which a baby is kept so that they will remain out of harm's way. Play yards can be very handy for caregivers as it offers a safe place to confine a baby, such as in the kitchen while the caregiver is cooking dinner or in the home office while a caregiver is working, for example. There remains a separate concern regarding play yards, beyond the scope of this discussion, of how to have the baby reside happily and independently in a play yard without starting to howl the instant she's put in! Having a line of sight through the sides of the play yard so the baby can see the caregiver may assist in this concern and it is very important that the caregiver always have the baby within their direct line of sight.

Play yards were traditionally made of wood, and consisted of a flat rectangular platform, usually rectangular in shape, with vertical slats on four sides, so that the baby can see out. The typical modern play yard has mesh sides and a floor that bends in the middle for folding. One common folding design has radiating floor struts extending to corner posts, wherein the floor struts are folded drawing the corner posts in a radial direction toward the hub as the play yard is moved to the stored or closed position. The mesh should have a small weave, less than ¼ inch, so the child's fingers and toes or buttons on the child's apparel can't get caught. On wooden models, the space between slats should be no wider than 2⅜ inches. It is crucial that play yards be set up properly with the floor properly positioned and the sides locked into place. The floor of the play yard may include a soft mat.

The walls or sides of the play yard are usually higher than the height of the child, so as to avoid climbing injuries. Play yards are generally for babies who weigh less than about 30 pounds and that are less than 36 inches high. In short, when it appears the child may be able to climb out of the play yard, it's time to give up the play yard. Within this application the terms babies, infants, toddlers and children can be used interchangeably without defining a significant difference between the meanings of the terms.

There are many modern and portable designs for play yards. The purpose of the play yard is to confine children who might otherwise wander off and hurt themselves. Further, children often enjoy the safety and comfort of the play yard, which can therefore be the preferred location for many activities.

As suggested above, portable play yards that collapse or fold have been developed. For example see U.S. Pat. No. 6,851,135 which discloses a foldable skeleton for a play yard. U.S. Pat. No. 6,634,038 provides a collapsible play yard with detachable cot, which is capable of accommodating a baby therein. U.S. Pat. No. Design 359,869 depicts a portable, collapsible baby mattress having a fabric base and two curved supports extending from opposite corners of the mattress and crossing above the center of the mattress. U.S. Pat. No. 6,357,462 provides a play yard for a baby that is easily collapsible and portable. Other similar patents describe collapsible play yard arrangements. However all of these devices are difficult to deploy and to store when they finished being used.

In particular folding designs having corner posts can often become unwieldy during the tear down operation as the corner posts are free to tip over away from the user as the unit is being stored. It is the objects of the present invention to address the deficiencies of the prior art collapsible play yards.

SUMMARY OF THE INVENTION

It is noted that, as used in this specification and the appended claims, the singular forms "a," "an," and "the" include plural referents unless expressly and unequivocally limited to one referent.

For the purposes of this specification, unless otherwise indicated, all numbers expressing quantities of ingredients, reaction conditions, and other parameters used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

All numerical ranges herein include all numerical values and ranges of all numerical values within the recited numerical ranges. Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

The various embodiments and examples of the present invention as presented herein are understood to be illustrative of the present invention and not restrictive thereof and are non-limiting with respect to the scope of the invention. According to one embodiment of the present invention addressing at least one of the above stated objects a folding play yard includes a collapsible play yard frame movable between a retracted stored position and a deployed position, wherein the frame defines a baby receiving portion in the deployed position with a floor and bordering side walls around the periphery of the floor, wherein the frame includes a plurality of corner posts forming at least a portion of a support for the side walls with the play yard in the deployed position, wherein the corner posts are constructed to remain substantially parallel to a vertical axis of the play yard as the play yard moves between the closed and the open position.

In one embodiment of the invention a controller is coupled to the frame for controlling a power assist mechanism for movement of the frame. The power assist mechanism may include a motor mounted on the frame and may further include a power source mounted on the frame for powering the motor, wherein the power source is a battery pack, such as a rechargeable battery.

These and other advantages of the present invention will be clarified in the description of the preferred embodiments taken together with the attached figures.

DESCRIPTION OF THE PREFERRED EMBODIMENTS

Figure 1:
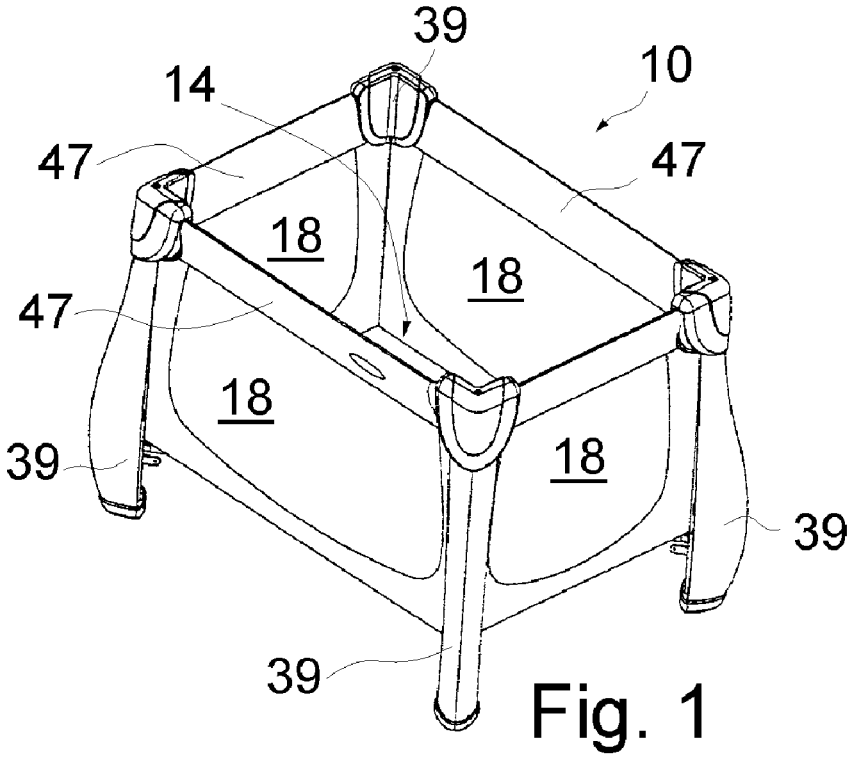
FIG. 1 is a perspective view of a portable, powered folding play yard according to one aspect of the present invention.
Figure 2:
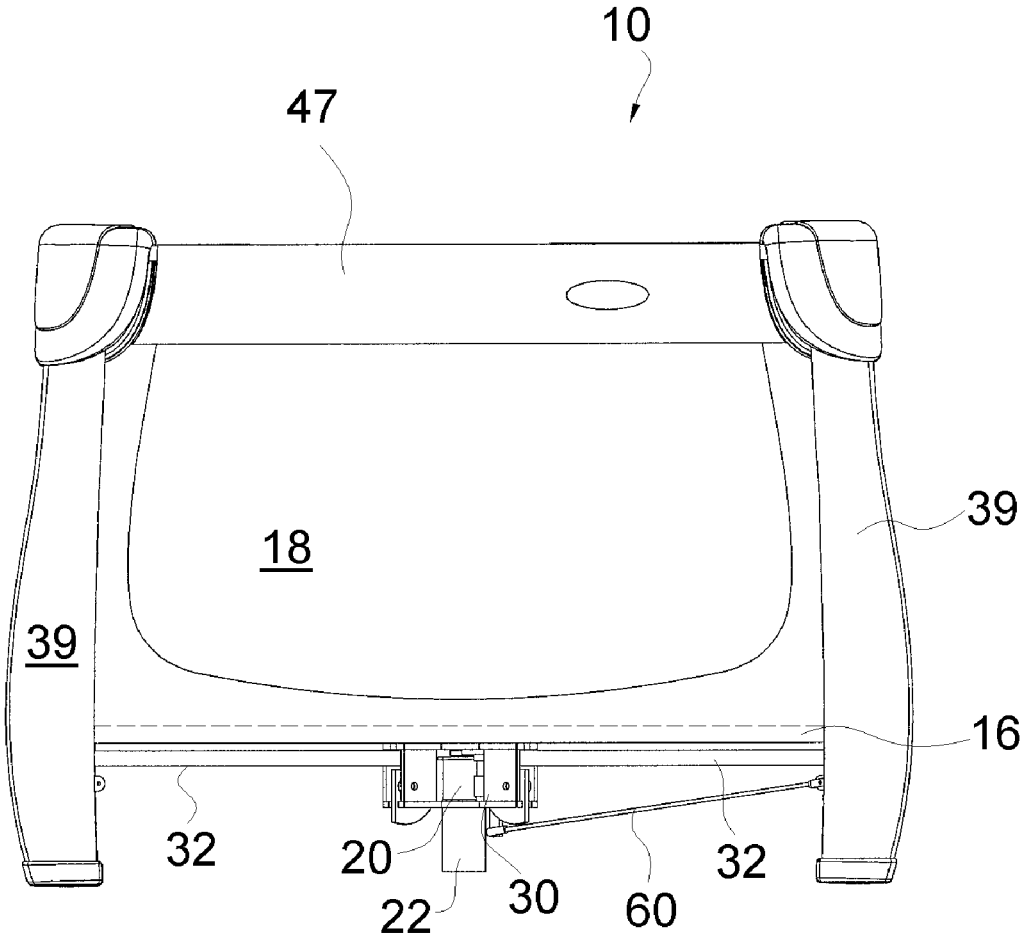
FIG. 2 is an elevation side view of the play yard of FIG. 1.

FIGS. 1-2 illustrate an embodiment of a portable, powered, free standing folding play yard 10 with child detecting safety. The term "powered" when referencing the play yard 10 within the meaning of this disclosure means that the play yard 10 can automatically move, once activated, between the closed position and the open position and between the open position and the closed position. As known in the art, play yards are used for infants or baby, toddlers and small children, which are referenced interchangeably herein.

Figure 3:
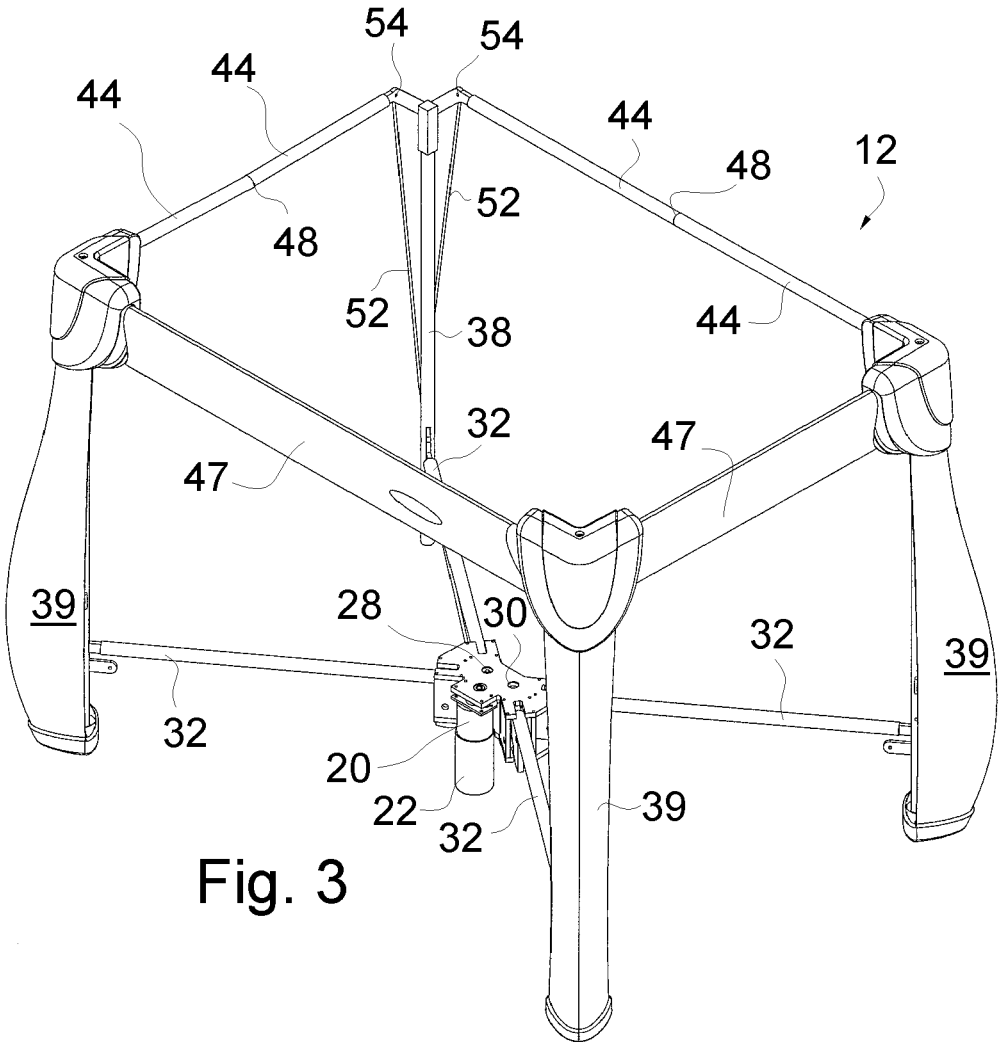
FIG. 3 is a perspective view of the play yard of FIG. 1 which omits selected covering elements to highlight the play yard frame.
Figure 4:
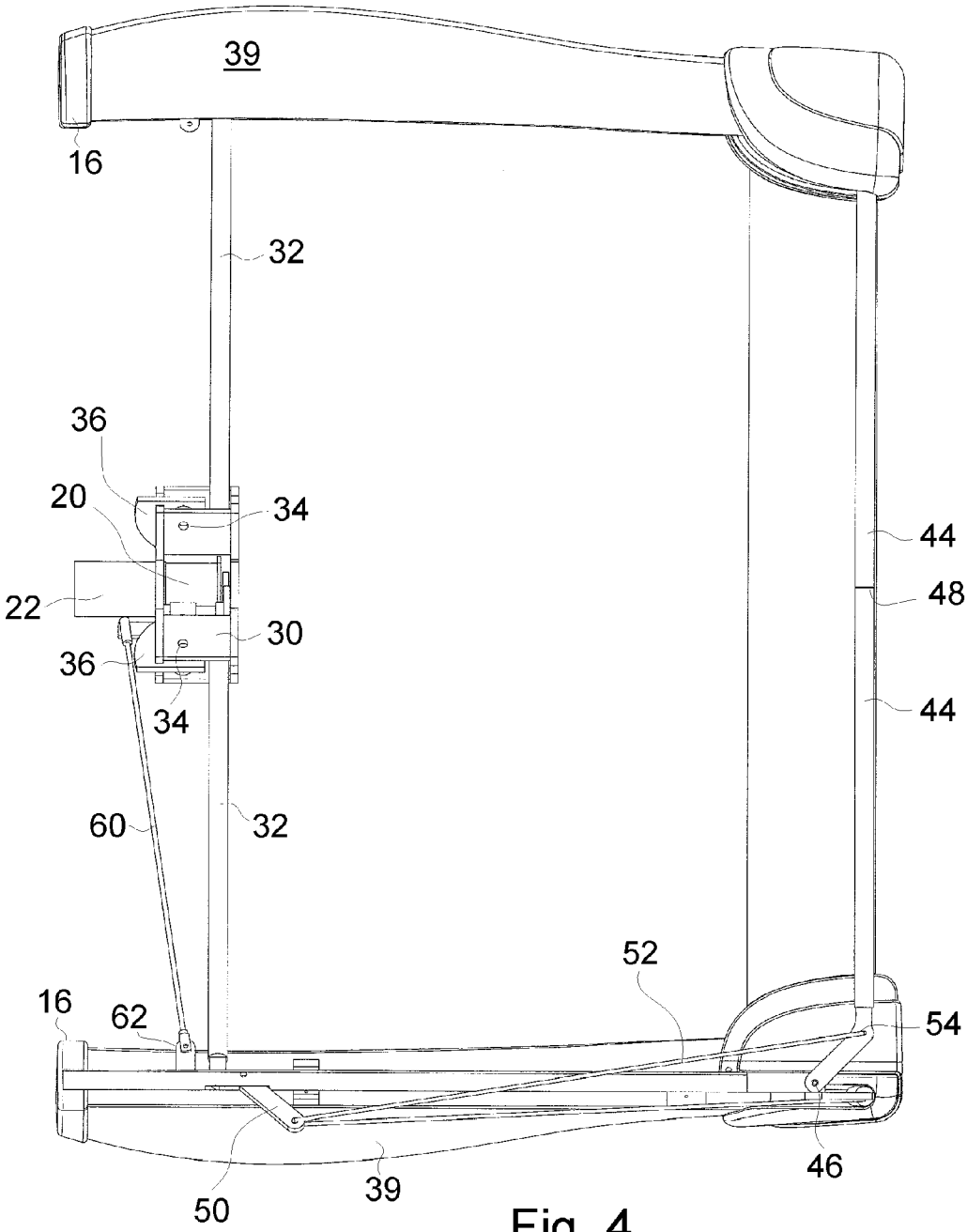
FIG. 4 is an elevation side view of the play yard of FIG. 3.
Figure 5:
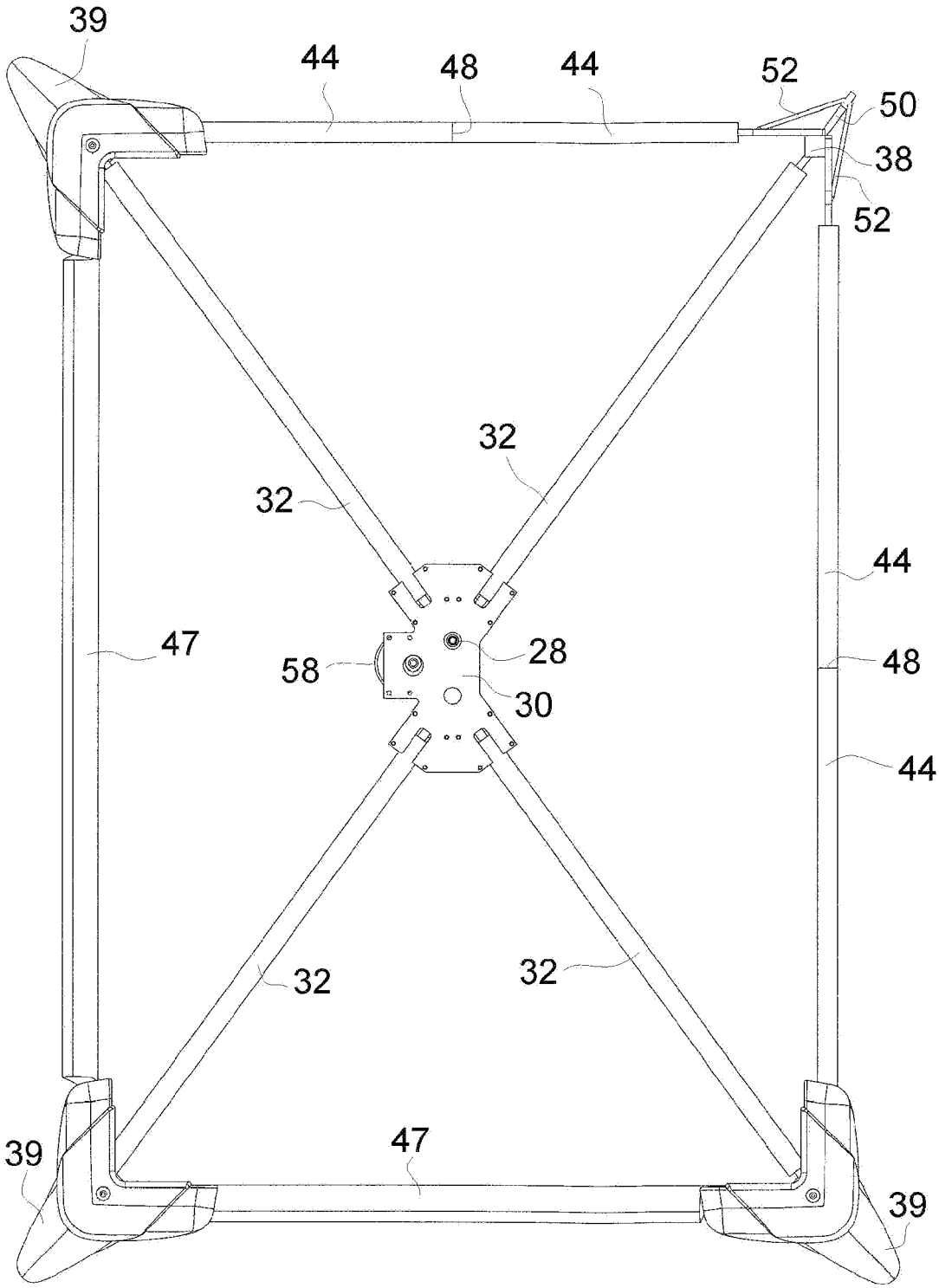
FIG. 5 is a top plan view of the play yard of FIG. 3.

The play yard 10 includes a collapsible play yard frame 12, best shown in FIGS. 3-5, movable between a retracted stored position and a deployed position shown in the figures. Collapsible frames 12 are well known in the art for forming collapsible portable play yards and may be formed of hollow aluminum tubes, plastic components or the like. The details of the particular frame 12 for one embodiment of the play yard 10 is described in greater detail in connection with FIGS. 3-9. The frame 12 defines a baby receiving portion 14 in the deployed position with a floor including a removable mat 16 and bordering side walls 18 around the periphery of the floor. The construction of a removable mat 16 is well known in the art and not detailed further herein. The frame 12 also supports a plurality of ground engaging feet at an end thereof adjacent the ground at least in the deployed position.

Rollers (Not Shown) may be provided to engage the ground in only the stored position to ease the transport of the portable play yard 10, wherein the rollers will move to a non-ground engaging position with the play yard 10 in the deployed position.

The play yard 10 has an actuator 20 (see FIGS. 6-7) coupled to the frame 12 for moving the frame 12 between both the retracted stored position and the deployed position and between the deployed position and the retracted position. The actuator 20 may be a ball screw mechanism wherein a rotary screw causes relative motion between the screw and a ball threaded thereon. The actuator 20 may be a rack and pinion mechanism in which a rotating pinion engages and causes linear movement of an engaged rack. The actuator may be a rod coupled to a piston. The actuator 20 is described in greater detail in connection with the particulars of the frame 1 2, and in embodiments of FIGS. 1-9 is formed of gear driven floor struts with linkages to couple the struts to corner posts and, The play yard 10 includes a power assist mechanism 22 coupled to the frame 12 for operating the actuator 20 for moving the frame 12. Within the meaning of this application power assist mechanism 22 will be a motor, such as an electric motor, or a pneumatic or hydraulic double acting piston cylinder assembly. A power source 24, see FIG. 8, may be mounted on the frame 12 for powering the motor, the power source 24 may be a battery pack, even a rechargeable battery pack. Alternatively the motor forming mechanism 22 can be powered from an external power source with a power cord (not shown).

Figure 8:
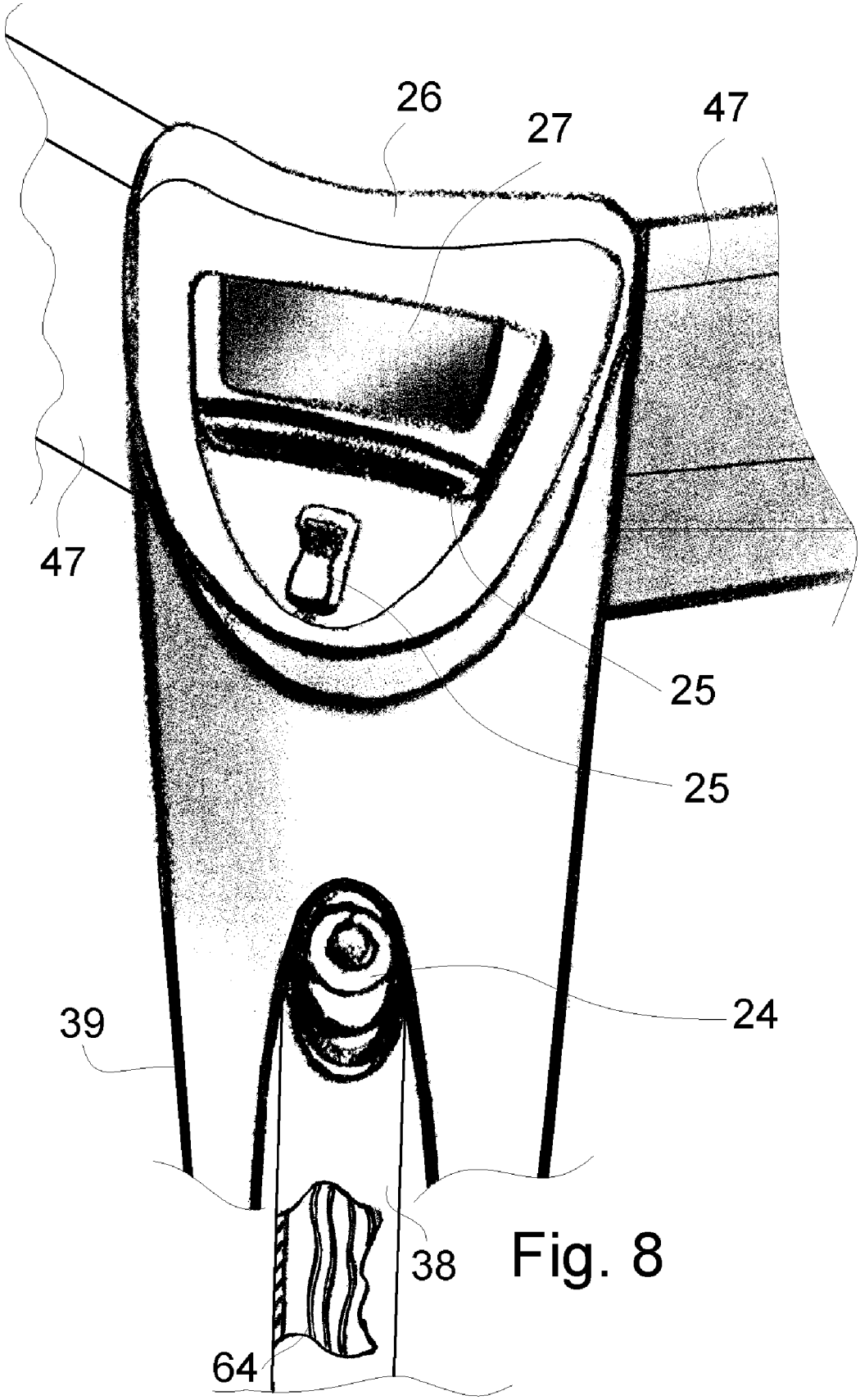
FIG. 8 is a schematic view of an integrated controller with a display, and electric control switch for the play yard according to the present invention.
Figure 10:
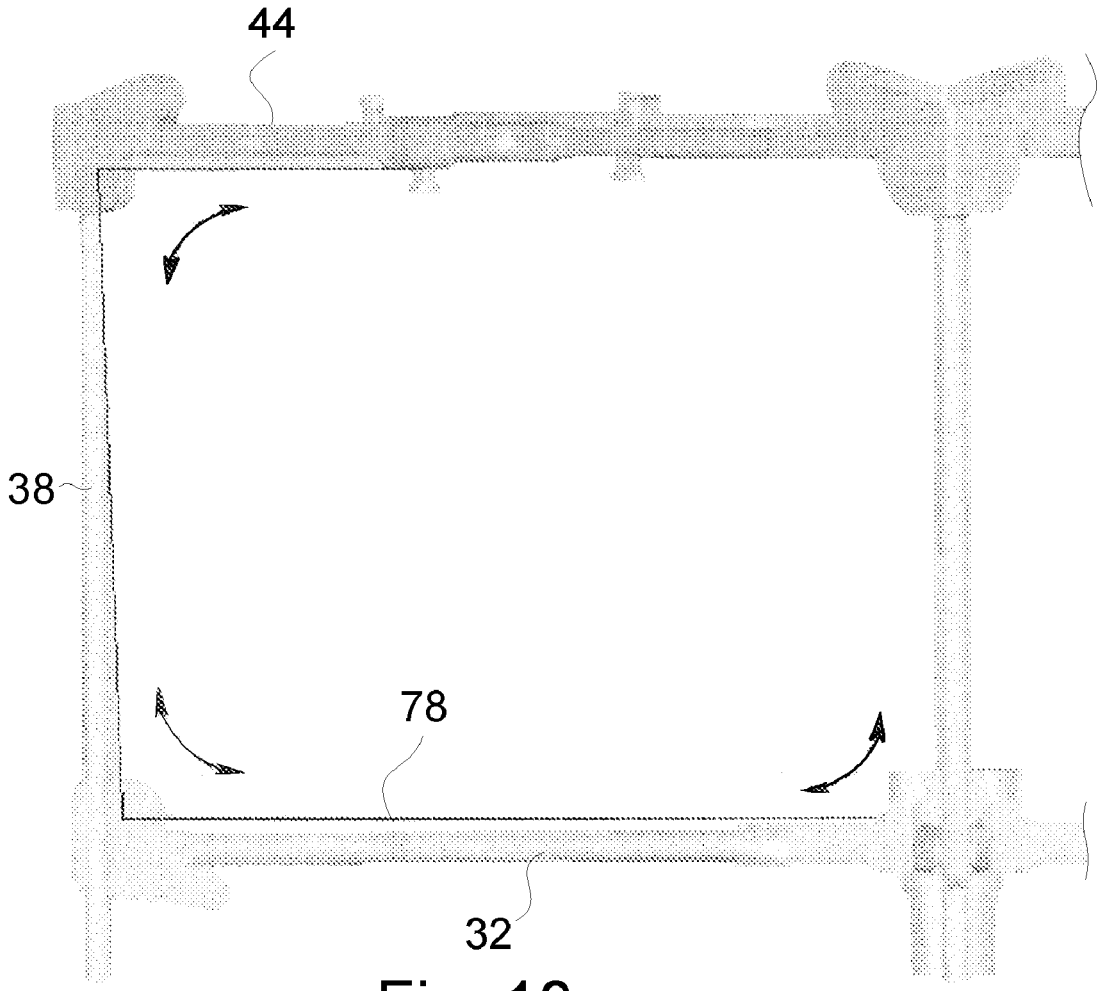
FIG. 10 is a schematic view of an alternative frame component coupling arrangement in accordance with the present invention.

The powered folding play yard 10 further includes a controller 26, see figure 8, for operating the power assist mechanism 22. The controller 26 includes a processor or microcontroller as known in the art. The controller 26 may include a controller button or switch 25 mounted on the frame 12 as shown in figure 10. In the illustrated embodiment, the switch 25 is formed of a pair of parallel spaced switches 25 that provide a child safety feature as both need to be engaged to actuate the system (and the sensor 28 must not indicate the possible presence of the child in closing operations). Further, it is anticipated that the switch 25 must be engaged through the opening or closing operation (also known as a dead man's switch arrangement). Finally, it is preferred if the controller will switch directions with each subsequent engagement, whereby, for example, should the closing operation be stopped part way through (because the caregiver notices a toy in a frame pinch point) the caregiver need only release the switch 25 and reengage for opposite operation (in case frame movement is needed to remove the obstacle blocking closure) then stop the process again and reengage to return to the closing operation.

Alternatively or additionally the controller 26 may be external to the frame 12 such as on a key fob using wireless technology. The corner post of the frame 12 serves as an easily accessed location for the provision of the controller 26 and the power source 24 (i.e. easily replaceable or rechargeable batteries). The power source 24 provides an integrated source of stored energy that can be used for other onboard systems as desired.

A display 27 can be included to give visual feedback to the user about the position of the frame, the presence of the baby, instructions for use, or environmental conditions (e.g. temperature within play area from other sensor, time, etc). The controller 26 could include other features such as alarm clock features, timer features, portable radio features, or other entertainment devices such as CD player, tape player, or the like).

In one embodiment of the present invention the powered folding play yard 10 is free standing as the play yard 10 is moved between the deployed position and the retracted position. Free standing within this application will reference that the play yard 10 will remain upright, effectively supported on the in a vertical orientation for the sidewalls throughout the movement without the need for external supports (i.e. the user need not hold it upright). In other words the caregiver can remove the baby from the portion 14 and easily push the button of controller 26 while holding the baby. The play yard 10 will be powered to the closed position and then can be easily picked up by the user and placed, for example, in the trunk of an automobile, or otherwise stored as desired, such as slipped into an outer carrying case. Further, in order to deploy the play yard 10, the care giver need only push and hold the button or switch 25 of the controller 26 once the freestanding play yard 10 has been placed onto the ground.

Another feature of the invention is that the powered folding play yard 10 further includes a child sensor 28 coupled to the baby receiving portion 14 wherein the child sensor 28 prevents the power folding play yard 10 from moving to the retracted position if the child sensor 28 detects the possibility of a baby in the baby receiving portion 14 . The sensor 28 may be a mechanical weight sensor, or a proximity sensor, a breaking the beam type light sensor, or other conventional sensor indicative of the presence of a baby within the portion 14. With the sensor 28 indicating the presence of a baby the sensor 28 can simply override the instructions from the controller 26 to close the play yard 10. In other play yard configurations (e.g. non-powered) the child sensor 28 may activate a physical lock preventing the folding of the frame 12. In the present embodiment the child sensor may indicate the possible presence of a baby when it detects the mat 16, whereby the sensor 28 will signal the possible presence of a baby within the baby receiving portion 14 when the mat 16 is in place and prevent the closing of the play yard 10 when the mat 16 is in place (and therefore a baby may be present). Therefore the play yard 10 may only be closed when the mat 16 is first removed, which will, in turn, require that the baby be removed prior to mat removal.

FIGS. 3-9 can be reviewed to illustrate some of the details and advantages of the present invention. The frame 12 can comprise a central hub 30 with four floor support struts 32 pivoted there to through pivot pin 34 in the center of a semicircular body 36. The peripheral portion of the body 36 includes gear teeth to form a gear. A full 360 degree gear is not needed for the body 36 as the associated strut 32 does not pivot through a full 360 degrees relative to the hub 30. The hub 30 and the floor support struts 32 support a floor mat that forms the floor and mat 16.

The frame 12 further comprises four corner posts 38. The corner posts 38 are pivoted to the struts 32 through pivot pin 40. The corner posts 38 are hollow tubular members as shown and further include an outer corner cap member 39. The corner posts 38 are parallel to a central "vertical" axis 42 through the hub 30 when in the deployed position. Further, as will be described hereinafter they are parallel to the vertical axis 42 as the play yard 10 moves between the closed and the open position and in the stored position as well.

Figure 9:
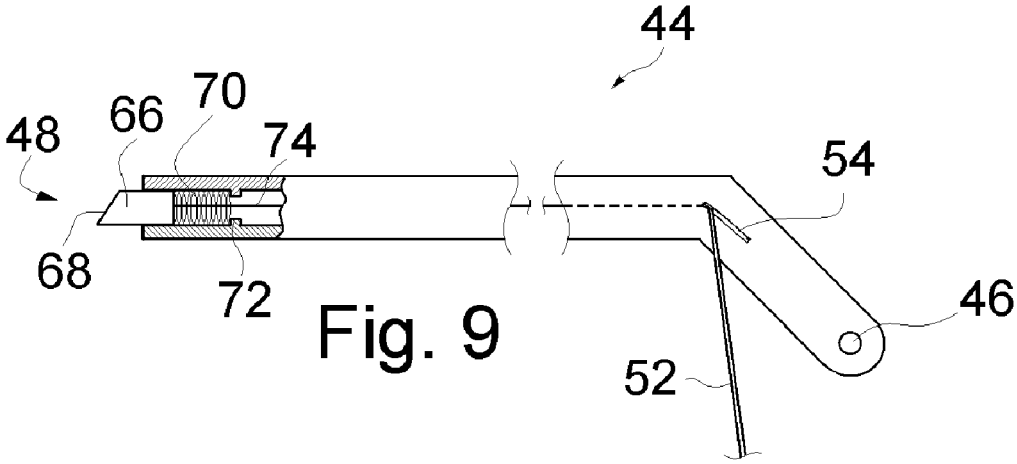
FIG. 9 is a schematic view of a top rail frame component according to one aspect of the present invention.

The frame 12 further comprises eight top rails 44 with two rails 44 that extend in perpendicular directions when in the deployed position coupled to each corner post 38 through pivot pin 46. The top rails 44 are sheathed in a cover 47 that forms the top of the sides 18. Each top rail 44 is coupled to an opposed top rail 44 from an adjacent corner post 38 at coupling connection 48 at a distal end of each rail 44. Details of a particular automatic latching and release configuration for the rail 44 is shown in FIG. 9 discussed below.

When in the deployed position the top rails 44 and the corner posts 38 support the side walls 18 of the play yard 10 which extend from the covers 47.

Each floor strut 32 includes an extension arm 50 extending beyond pivot pin 40. The extension arm 50 includes a dual pusher rod 52 (which may, of course be formed of two separate rods). The dual pusher rod 52 extends from the arm 50 in a bifurcated fashion extending and coupled to two top rails 44 at attachment point 54. The extension 50 and pusher rod 52 couples the movement of each floor strut 32 to the movement of the associated rails 44. As the floor strut 32 is moved to the deployed position the pusher rod moves the rails 44 into the deployed position. Similarly, as the floor strut 32 is moved to the stored position the pusher rod moves the rails 44 into the stored position. The extension arms 50 and associated dual pusher rods 52 form part of the actuator 20 of the play yard 10.

Figure 6:
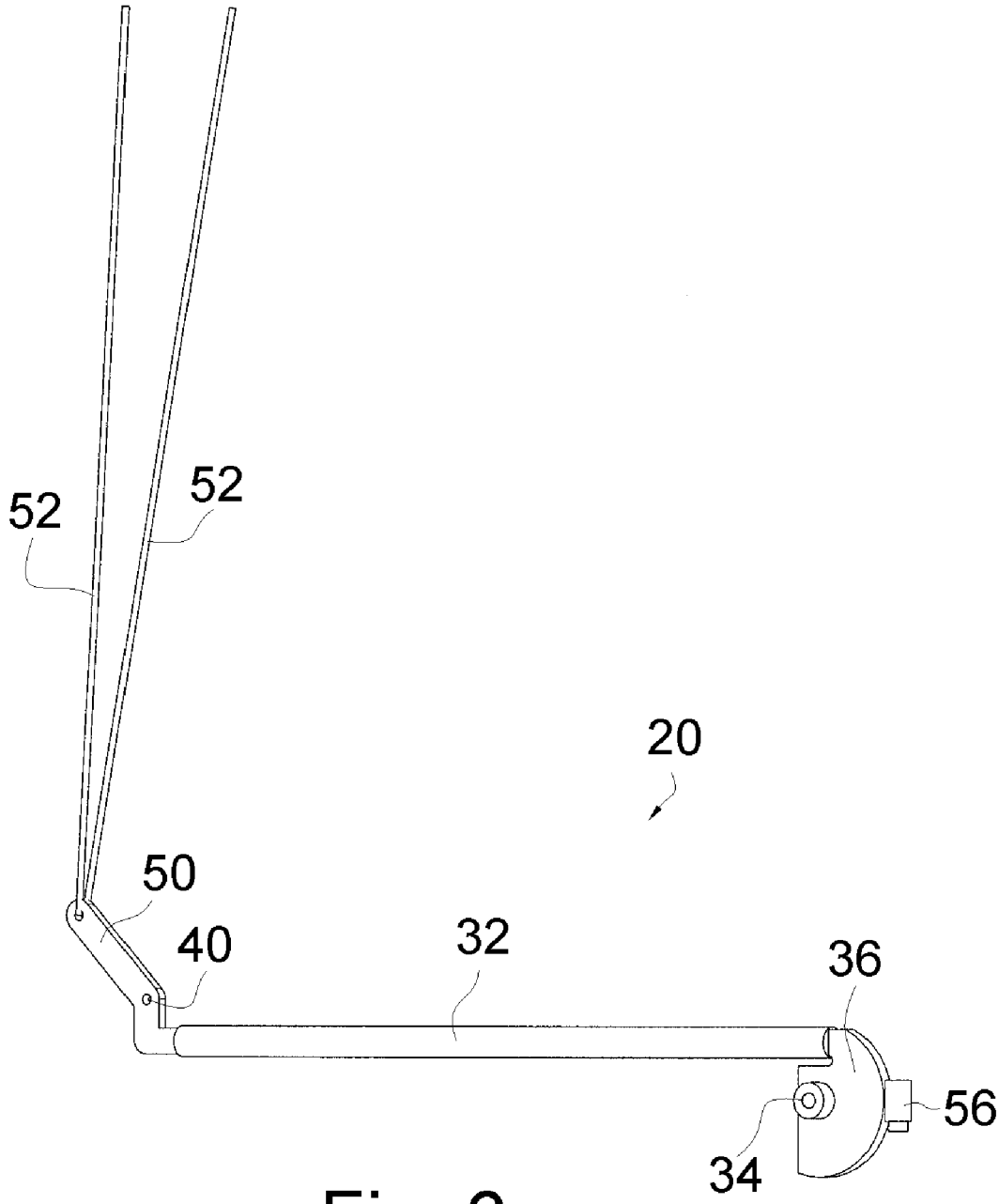
FIG. 6 is a perspective view of a floor strut and associated pusher rods of the play yard of FIG. 3.
Figure 7:
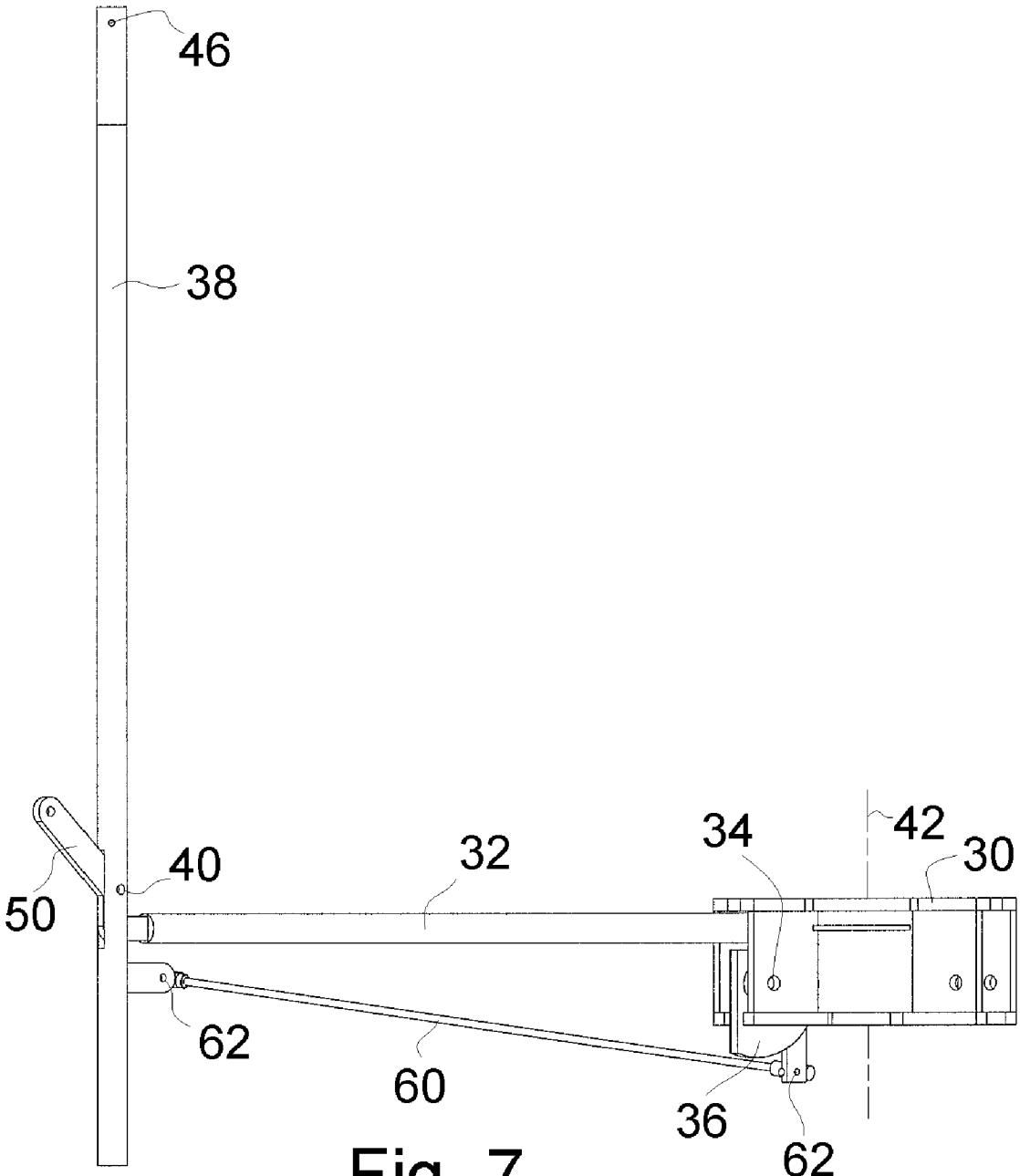
FIG. 7 is a perspective view of a central hub, floor strut and associated pusher rods, corner post and stabilizing bar of the play yard of FIG. 3.

With reference to FIGS. 5 and 6 the actuator 20 further includes four worm gears 56 mounted on the hub 30 with each gear 56 meshed with the peripheral gear teeth on the body 36. As discussed above the power assist mechanism 22 may be a reversible motor 58 mounted on the hub 30, which drives the gears 56 in either direction. Appropriate limit switches may be provided for stopping the motor 56 in the fully deployed or fully stored position.

The sensor 28 may be effectively mounted on the hub 30 as shown, or on the floor struts 32. It may be a weight actuated sensor that indicates the possible presence of the child whenever the floor mat 16 is placed upon the hub 30 and struts 32. This type of child presence sensor will prevent the closing of the play yard 10 when the floor mat is in place (and a baby may be within the play yard 10) by signaling the controller 26 which would override the actuation of the push button until the sensor indicates that no baby is present (or more precisely both the baby and the underlying mat has been removed). Other types of child sensing mechanisms may be implemented and used to supplement or replace the sensors 28.

The frame 12 further includes a stabilizing bar 60 extending between the hub 30 and each corner post 38 and attached there to through pivot pins 62. The stabilizing bar 60 will act to maintain the associated corner post 38 parallel to the vertical axis 42 as the corner post 38 is moved to the stored position. Only one corner post stabilizing bar 60 is shown, but each corner post 30 may be provided with one, or only two corner posts or only one corner posts (whereby the remaining inter-engaged frame components will restrain and align the remaining corner posts 38).

Another important feature of the present invention is that the tubular frame members (38, 32 and even 44 if needed), provide for hidden wiring conduit for power and data wires 64 extending from the controller 26 and the power source 24 to the power assist mechanism 22 and to and from the sensors 28 and frame position(described below). The wires 64 are shown in FIG. 8.

As noted above FIG. 9 illustrates an automatic latching and release configuration for the top rails 44 and the associated frame 12. In this configuration the coupling 48 is formed of a locking member 66 having an upper ramped edge 68 that is outwardly biased by spring 70 abutting stops 72. In the opening movement of the frame 12 the rails 44 are pushed by respective rods 52 and the ramp 68 will allow the locking member 66 to be pushed against the spring 70 until the rails are aligned and the member 66 is securely received within the opposed rail 44 securely locking the rails 44 together. The baby, even if she can reach the rails 44 cannot reach or disengage the locking member 66. For disengagement, a cable 74 is coupled to and extends between the member 66 and the rod 52. Further the connection 54 is now formed as a slot 54 as shown whereby initial movement of the rod 52 during disengagement will move rod along slot 54 pulling cable 74 and withdrawing locking member 66. When the rod reaches the other end of slot 54 the member 66 will be fully disengaged allowing the rail to be lowered through further movement of the rod 52. This provides a single actuator for latching and moving the rails 44 and through use of several of these rails, the entire frame 12.

The present invention further includes frame position sensors for indicating to the controller the position of the frame 12 (e.g. whether it is fully deployed or fully stored or somewhere in between). The frame sensors can take many forms. Frame position sensors may be through an encoder within the gear box of the motor forming power assist mechanism 22 and actuator 20. The frame position sensors may be rotary encoders at any frame component pivot point (e.g. 34, 40, and/or 46). The frame position sensors may be merely limit switches or contact switches that are selectively engaged as the frame reaches the designated position.

The present invention further includes the advantage of being self supporting when in the closed position. The present design provides for a frame with inter-engaged frame components that consequently move simultaneously. Further the motor forming the power assist mechanism 22 will hold the frame in the closed position without other elements. This is believed to be of great assistance to the users who need not fumble with frame components that are flopping to the side as in prior art designs. Further, if the motor is replaced for a non-motorized version, then a releasable latch (snap fit or the like) on one or more of the frame components that engages when the frame is in the fully stored position should be added to provide the self supporting feature in the closed position.

Alternative embodiments may only include selected features of the present invention, for example having geared floor struts, or having the top rail coupled to the strut movement, or having one or more corner post stabilizing bars may be incorporated selectively in motorized or manual play yard configurations. The single motor could be replaced with two motors each driving one half of the total frame, or ultimately each frame linkage could have its own power assist mechanism such as a piston-cylinder.

The present invention is not intended to be limited to the pusher rod system described. FIG. 10 schematically illustrates a frame 12 in which the movement of the struts 32 is coupled to the movement of the top rails through a connecting cable 78 reeves around associated pulleys. One cable line will be provided for pulling the frame closed and one for pulling the components open (as the cables can only pull rather than push and pull as can rods 52). This schematic is provided to demonstrate some of the breadth of the current disclosure.

Whereas a particular embodiment of this invention has been described above for purposes of illustration, it will be evident to those skilled in the art that numerous variations of the details of the present invention may be made without departing from the invention as defined in the appended claims. The scope of the present invention is intended to be defined by the appended claims and equivalents thereto.

What is claimed is:

1. A folding play yard including a collapsible play yard frame movable between a retracted stored position and a deployed position, wherein the frame defines a baby receiving portion in the deployed position with a floor and bordering side walls around the periphery of the floor, wherein the frame includes a plurality of corner posts forming at least a portion of a support for the side walls with the play yard in the deployed position, wherein the corner posts are constructed to remain substantially parallel to a vertical axis of the play yard as the play yard moves between the closed and the open position, further including a child sensor coupled to the baby receiving portion and electronically coupled to a microprocessor wherein the child sensor prevents the microprocessor from causing the collapsible play yard frame to move to the retracted position if the child sensor detects a baby in the baby receiving portion.

2. The folding play yard according to claim 1 wherein the play yard is free standing with the corner posts substantially parallel to the vertical axis of the play yard as constructed wherein the play yard moves between the deployed position and the retracted position preventing the corner posts from being free to tip over away from the user.

3. A folding play yard including a collapsible play yard frame movable between a retracted stored position and a deployed position, wherein the frame defines a baby receiving portion in the deployed position with a floor and bordering side walls around the periphery of the floor, wherein the frame includes a plurality of corner posts forming at least a portion of a support for the side walls with the play yard in the deployed position, wherein the corner posts are constructed to remain substantially parallel to a vertical axis of the play yard as the play yard moves between the closed and the open position, further including an actuator coupled to the play yard frame for moving the frame between both the retracted stored position and the deployed position and at the deployed position and the retracted position; and a power assist mechanism coupled to the frame for operating the actuator for moving the frame, and further including a microprocessor coupled to the frame for controlling the power assist mechanism and the movement of the frame.

4. The folding play yard according to claim 3 further including a child sensor coupled to the baby receiving portion wherein the child sensor prevents the collapsible play yard frame from moving to the retracted position if the child sensor detects a baby in the baby receiving portion.

5. A folding play yard including a collapsible play yard frame movable between a retracted stored position and a deployed position, wherein the frame defines a baby receiving portion in the deployed position with a floor and bordering side walls around the periphery of the floor, wherein the frame includes a plurality of corner posts forming at least a portion of a support for the side walls with the play yard in the deployed position, wherein the corner posts are constructed to remain substantially parallel to a vertical axis of the play yard as the play yard moves between the closed and the open position, further including an actuator coupled to the play yard frame for moving the frame between both the retracted stored position and the deployed position and at the deployed position and the retracted position; and a power assist mechanism coupled to the frame for operating the actuator for moving the frame, wherein the power assist mechanism includes a motor controlled by a microprocessor mounted on the frame.

6. The folding play yard according to claim 5 further including a power source mounted on the frame for powering the motor.

7. The folding play yard according to claim 6 wherein the power source is a battery pack.

8. The folding play yard according to claim 5 further including a child sensor coupled to the baby receiving portion wherein the child sensor prevents the power folding play yard from moving to the retracted position if the child sensor detects a baby in the baby receiving portion.

9. A folding play yard having a collapsible play yard frame movable between a retracted stored position and a deployed position, wherein the frame defines a baby receiving portion in the deployed position with the play yard having a floor and a side wall around the periphery of the floor, wherein the frame comprises: a central hub defining a central vertical axis for the play yard; a plurality of floor supporting struts coupled to the central hub and constructed to pivot between a retracted stored position and an extended deployed position, wherein the struts and the central hub form at least a portion of a support for the floor with the play yard in the deployed position; a plurality of corner posts forming at least a portion of a support for the side walls with the play yard in the deployed position, wherein the corner posts are constructed to remain substantially parallel to the vertical axis as the play yard moves between the closed and the open position; and further comprising a child sensor coupled to the baby receiving portion and electronically coupled to a microprocessor wherein the child sensor prevents the microprocessor from causing the folding play yard to move to the retracted position if the child sensor detects a baby in the baby receiving portion.

10. The folding play yard according to claim 9 further including at least one stabilizing bar extending between the central hub and a corner post to maintain the corner post substantially parallel to a central vertical axis as the play yard moves between the closed and the open position.

11. The folding play yard according to claim 9 further including a plurality of top rails coupled to the corner posts and forming at least a portion of a support for the side walls with the play yard in the deployed position, wherein the top rails are constructed to pivot between a retracted stored position and an extended deployed position.

12. The folding play yard according to claim 11 further including a coupling assembly extending between the floor supporting struts and the top rails, wherein the coupling assembly is constructed to have the top rails and the floor struts move simultaneously between the stored position and the deployed position.

13. The folding play yard according to claim 9 further including eight top rails with two rails that extend in perpendicular directions when in the deployed position coupled to each corner post.

14. A folding play yard having a collapsible play yard frame movable between a retracted stored position and a deployed position, wherein the frame defines a baby receiving portion in the deployed position with the play yard having a floor and a side wall around the periphery of the floor, wherein the frame comprises:

a central hub defining a central vertical axis for the play yard;

a plurality of floor-supporting struts coupled to the central hub and constructed to pivot between a retracted stored position and an extended deployed position, wherein the struts and the central hub form at least a portion of a support for the floor with the play yard in the deployed position;

a plurality of corner posts forming at least a portion of a support for the side walls with the play yard in the deployed position, wherein the corner posts are constructed to remain substantially parallel to the vertical axis as the play yard moves between the closed and the open position; and a child sensor coupled to the baby receiving portion and electronically coupled to a microprocessor wherein the child sensor prevents the microprocessor from causing the collapsible play yard frame to move from the deployed position to the retracted stored position if the child sensor detects a baby in the baby receiving portion.

* * * * *